US007186192B1

(12) United States Patent
Suissa

(10) Patent No.: US 7,186,192 B1
(45) Date of Patent: Mar. 6, 2007

(54) BALL RETURN SYSTEM

(76) Inventor: Peter Suissa, 5838 Mclynn, Montreal, Quebec (CA) H3X 2R2

( * ) Notice: Subject to any disclaimer, the term of this patent is extended or adjusted under 35 U.S.C. 154(b) by 0 days.

(21) Appl. No.: 11/205,416

(22) Filed: Aug. 17, 2005

(51) Int. Cl.
*A63B 69/00* (2006.01)

(52) U.S. Cl. ..... 473/423; 473/430

(58) Field of Classification Search ..... 473/422, 473/423–425, 429, 450, 458, 464, 615, 511, 473/506–508; 273/317.8, 390, 391, 393, 273/386, 335, 334, 329–331
See application file for complete search history.

(56) References Cited

U.S. PATENT DOCUMENTS

| | | | | | |
|---|---|---|---|---|---|
| 702,910 | A | * | 6/1902 | Austin et al. | 124/16 |
| 824,560 | A | * | 6/1906 | Martin | 273/331 |
| 1,655,599 | A | | 1/1928 | Dolan | |
| 2,307,905 | A | * | 1/1943 | Ament | 119/708 |
| 2,506,825 | A | * | 5/1950 | Carlson | 235/103 |
| 3,051,491 | A | * | 8/1962 | Cabot | 473/147 |
| 3,658,330 | A | * | 4/1972 | Maestracci et al. | 473/429 |
| 3,829,093 | A | * | 8/1974 | Abrams | 473/575 |
| 3,874,662 | A | * | 4/1975 | Harrington | 473/417 |
| 3,907,287 | A | | 9/1975 | Fox et al. | |
| 4,088,319 | A | * | 5/1978 | Clarke | 473/575 |
| 4,162,790 | A | * | 7/1979 | Kelsey | 437/575 |
| 4,240,629 | A | * | 12/1980 | Song et al. | 473/575 |
| 4,248,423 | A | * | 2/1981 | Lotfy | 473/571 |
| 4,966,367 | A | | 10/1990 | Oyarzabal | |
| 5,054,786 | A | * | 10/1991 | Solomon | 473/147 |
| 5,255,911 | A | * | 10/1993 | Preston et al. | 473/423 |
| D365,128 | S | * | 12/1995 | Testasecca et al. | D21/309 |
| 5,516,116 | A | * | 5/1996 | Castro | 473/429 |
| 5,531,438 | A | * | 7/1996 | Corley | 473/429 |
| 5,611,540 | A | * | 3/1997 | Williams et al. | 473/429 |
| D438,582 | S | * | 3/2001 | Speers et al. | D21/719 |
| 6,302,814 | B1 | * | 10/2001 | Cade | 473/594 |
| 6,328,665 | B1 | * | 12/2001 | Gormley | 473/423 |

* cited by examiner

*Primary Examiner*—Mitra Aryanpour
(74) *Attorney, Agent, or Firm*—Cook, Alex, McFarron, Manzo, Cummings & Mehler; Edward D. Manzo; Renee Barthel

(57) ABSTRACT

A ball return apparatus includes a base, a substantially vertical pole extending from the base, an extensible tether extending from the pole, and a ball connected to the tether. The preferred base has a hollow interior and a closure so that the base can be filled with water or sand. The pole is mounted for articulation relative to the base, and a compression spring resists such articulation and causes the pole to return to its rest position. The tether has an extension spring connected to an elastic member. A swivel is at the end of the tether. An attachment device or plug connects to the ball. A glow ball or other ball can be used.

20 Claims, 5 Drawing Sheets

BALL RETURN SYSTEM

BACKGROUND OF THE INVENTION

The present invention relates to a ball return apparatus involving a ball tethered to a pole or other mount.

SUMMARY OF THE INVENTION

The invention is set forth more particularly in the claims but generally involves a pole extending from a base member with a tether connecting a ball to the pole. Preferably the base member has a hollow interior adapted to be filled with sand or liquid. Preferably the pole is connected to articulate from the base member under resistance imposed by a spring or other resilient means, preferably a compression spring. Preferably the tether which extends from the top or upper portion of the pole comprises an extension spring along with an elastic member. Preferably an adapter is used to connect to the ball, the adapter having a shank, a flange, and a conical section with an opening or channel therethrough. Preferably the pole is a low-rise pole, and the ball height above the ground is suitable for hitting the ball with a racquet.

BRIEF DESCRIPTION OF THE DRAWINGS

In describing the preferred embodiment of the present invention, reference is made to the appended drawings wherein.

DETAILED DESCRIPTION OF A PREFERRED EMBODIMENT

A description of a preferred embodiment of the present invention according to its several aspects is set forth herein with reference to the accompanying figures. It is to be understood, however, that this description and the figures are not the only manner of practicing the present invention and that other embodiments according to the invention can be devised.

Figure 1:
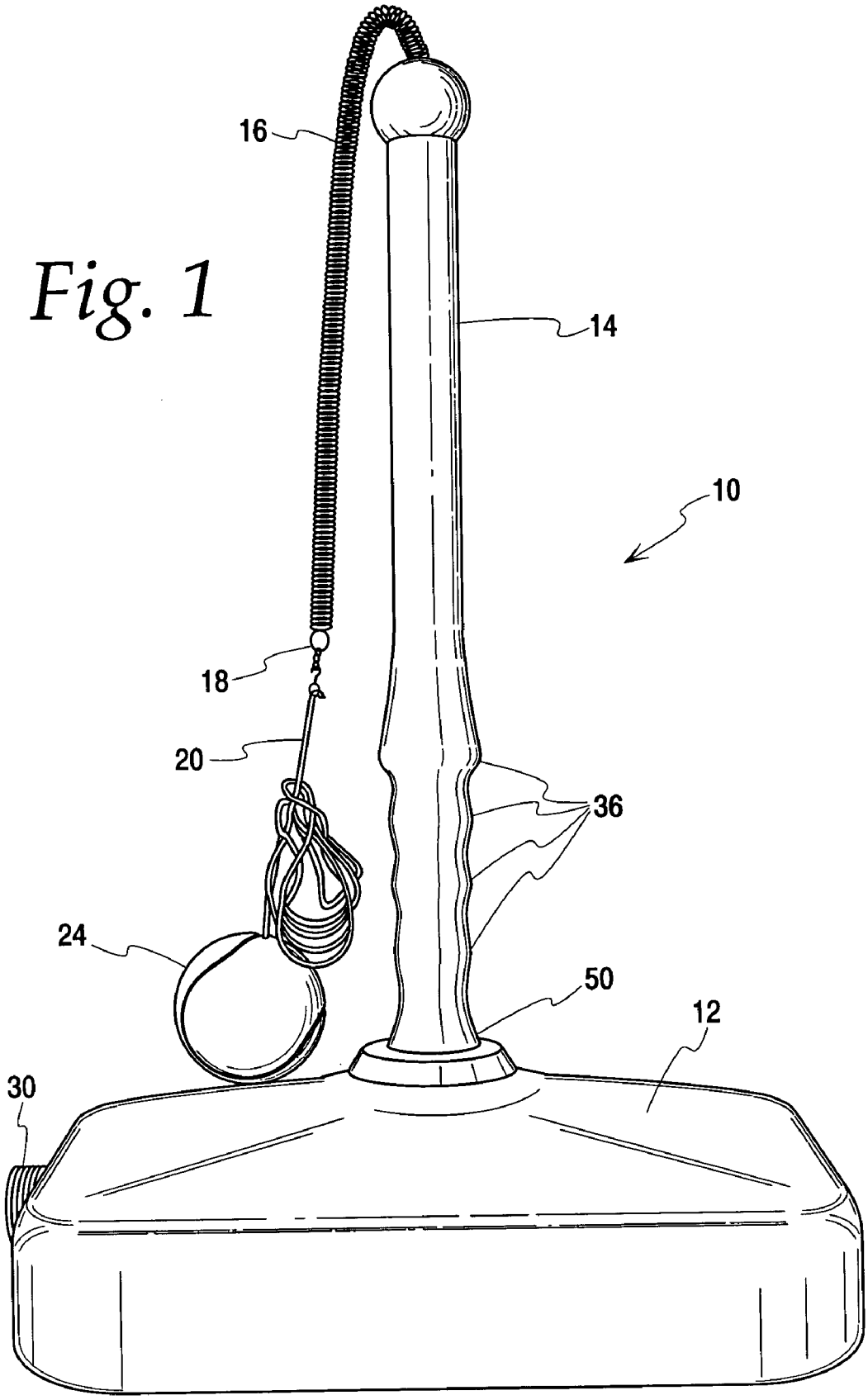
FIG. 1 is a side view of a preferred embodiment.

FIG. 1 is a side elevation view of one illustrative ball return apparatus 10 according to several aspects of the present invention. Apparatus 10 may be regarded as a game, recreational device, fitness device, or practice device for racquet sports. Preferably apparatus 10 includes a base member 12 having a pole 14 extending therefrom. Extending preferably from the upper end of pole 14 is an extension spring 16. At the far end of extension spring 16 is a swivel 18 which connects extension spring 16 to a braided elastic member 20. The spring 16 and elastic member 20 may together be regarded as a tether. The far end of elastic member 20 is connected to a ball, preferably via a ball attachment device 22 which itself is attached to a practice ball 24.

Base member 12 is intended to support pole 14 and to provide stability. A preferred base member 12 is made of plastic, colored black on the outside surface, being generally rectangular but with rounded corners and measuring, illustratively, about 1 foot wide by 10.5 inches long, by 3 inches high, approximately. Base member 12 can be made of blow molded plastic having an internal cavity that is fillable with water or sand or the like. Illustratively, a base fillable with 3 liters of water or sand is suitable. The fluid or sand can be inserted to the inside of the base member 12 via an opening or spout 30. Preferably, the opening is sealed by a twist cap illustratively made of plastic of the sort typically used to seal gallon containers of water or other liquid. A washer may be associated with the twist cap 32 for sealing the cap to the opening. It will be understood, however, that other embodiments of base member 12 can be used and may comprise, for example, a solid member made of plastic or hard rubber, or a metal or another solid material, which may or may not require filling. It may also comprise a hollow metallic member which may have a spout to be filled with water or sand or other substance. The particular size of base 12 may be varied so long as it provides stability to the overall unit 10 and supports pole 14.

It will be noted from the figures that the opening or spout 30 by which water or sand or other material is admitted into the interior of base member 12 is illustratively on a substantially vertical face of a side of base member 12. The specific location of the opening 30 is not critical, so long as it communicates with the interior of base member 12. It can, for example, be located on a top surface or on the bottom (underside) of base member 12.

Pole 14 is preferably a tube made of injection molded plastic with preferred dimensions of approximately 15 inches by 1 inch diameter. As can be seen from FIG. 1, pole 14 is generally cylindrical at its upper portion but may have waves or ridges on a lower segment, such as the bottom third of the length of pole 14. Preferably pole 14 is hollow. Preferably pole 14 is connected to base member 12 so that it projects substantially vertically from base 12. In one embodiment, the top of the pole 14 is located between about 15 and about 24 inches above the bottom of the base member 12. However, the connection of pole 14 to base member 12 is preferably non-rigid so that pole 14 can articulate in any angle, so that in use, pole 14 may move in response to movements of the ball 24. This is achieved preferably through use of a compression spring 40 (See FIG. 2A.) Thus, compression spring 40 may be attached to pole 14 by a cross pin 41 through pole 14 near the bottom of pole 14. Spring 40 extends through a centrally located opening 42 in base member 12. The compression spring may extend through a channel of base 12 (so it is not exposed to the water or sand) and project through to the underside of base member 12 where a washer 44 and wing nut 46, or other suitable connectors, may secure the bottom of the compression spring 40.

The diameter of the channel or opening 42 is narrower than a base portion 50 of pole 14. Preferably pole 14 can be placed upon base 12, which may include an annular collar 52 rising up from the top of base 12 at a central location. Collar 52 has an inside diameter larger than the outside diameter of pole 14 and thus receives the lower portion 50 of pole 14 and the downward depending compression spring 40 mounted thereto. Once the bottom end of the compression spring is secured using washer 44 and wing nut 46 (See FIGS. 2 and 2A), the pole 14 is movably mounted on base member 12 and can be angled away from the normal vertical position in any direction. It will be understood that any apparatus for connecting the pole 14 to the base member 12 will be suitable if it permits pole 14 to articulate relative to the base member 12 and spring back to its nominal vertical position, or spring beyond that nominal position and then return to the nominal position. It will be understood that the spring action promotes the functionality and accordingly the enjoyment from ball return apparatus 10.

Figure 2:
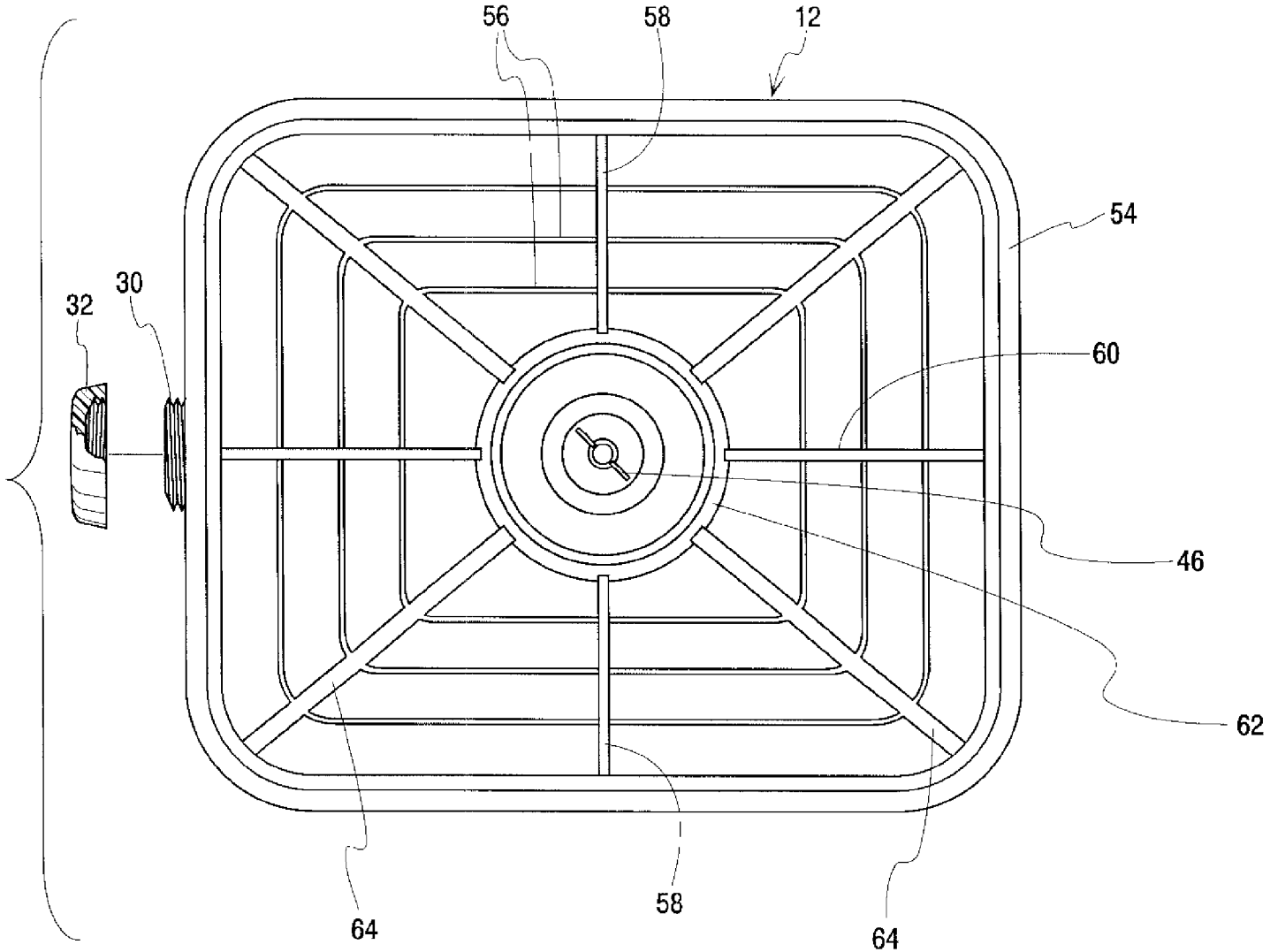
FIG. 2 shows the underside of the base.
Figure 2A:
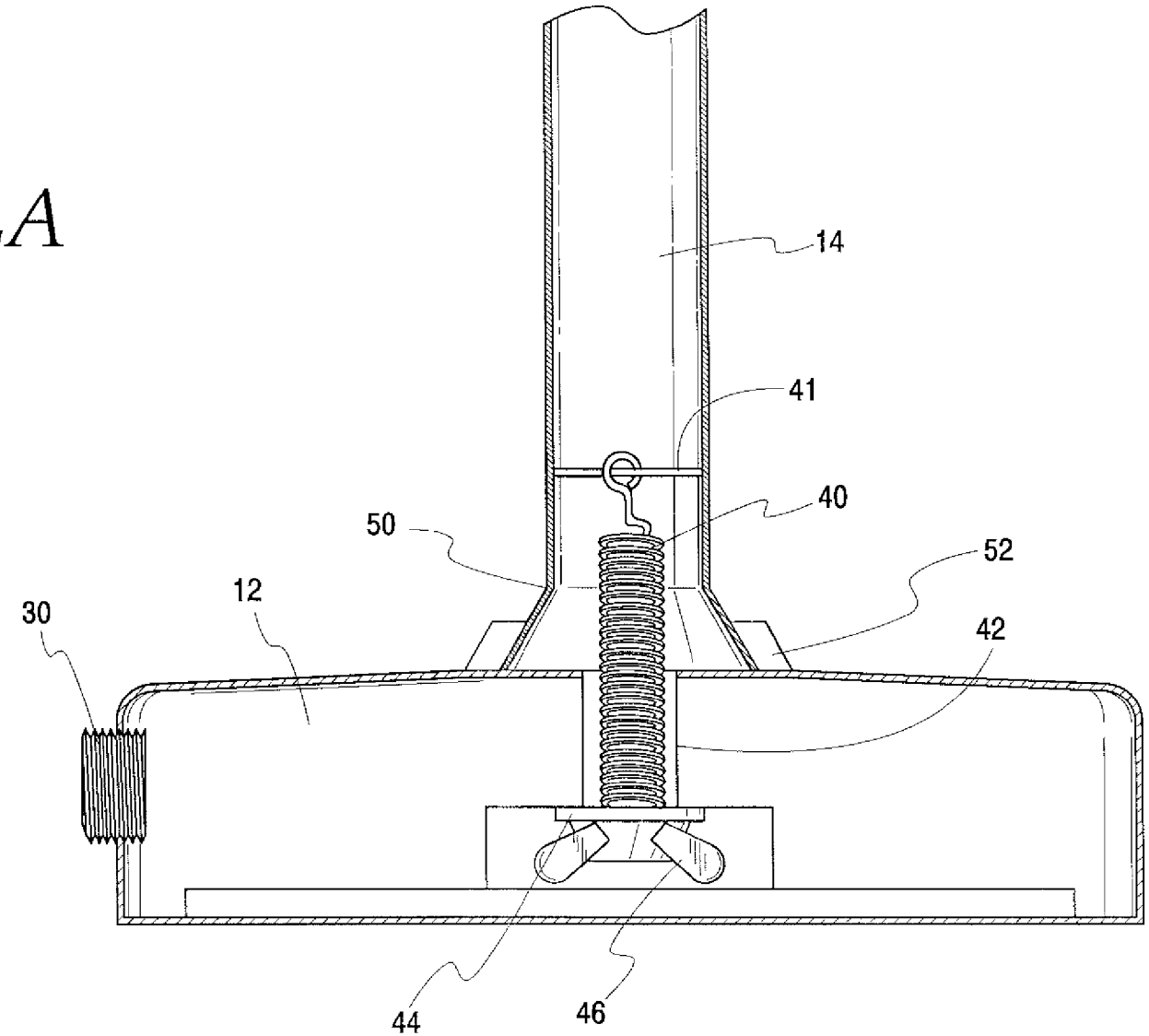
FIG. 2A is a sketch representing the connection of the pole to the base with the associated compression spring of the preferred embodiment.

FIG. 2 shows the underside of base member 12. As can be seen, the underside may have various structures which impart rigidity and may include, for example, an outer perimeter or ridge 54, a series of progressively smaller generally rectangular ridges 56, vertical and horizontal ridges 58, 60, respectively, a central annular ridge 62 projecting downward, and radially oriented ridges 64 extending from the annular ridge 62 to respective corners of the outer perimeter ridge 54.

Thus, the ability of the pole 14 to bend relative to base member 12 adds a safety feature in the event that anyone may fall accidentally upon the apparatus 10. Preferably, pole 14 will bend at the bottom away from the base member 12 and avoid or minimize any injury.

Figure 3:
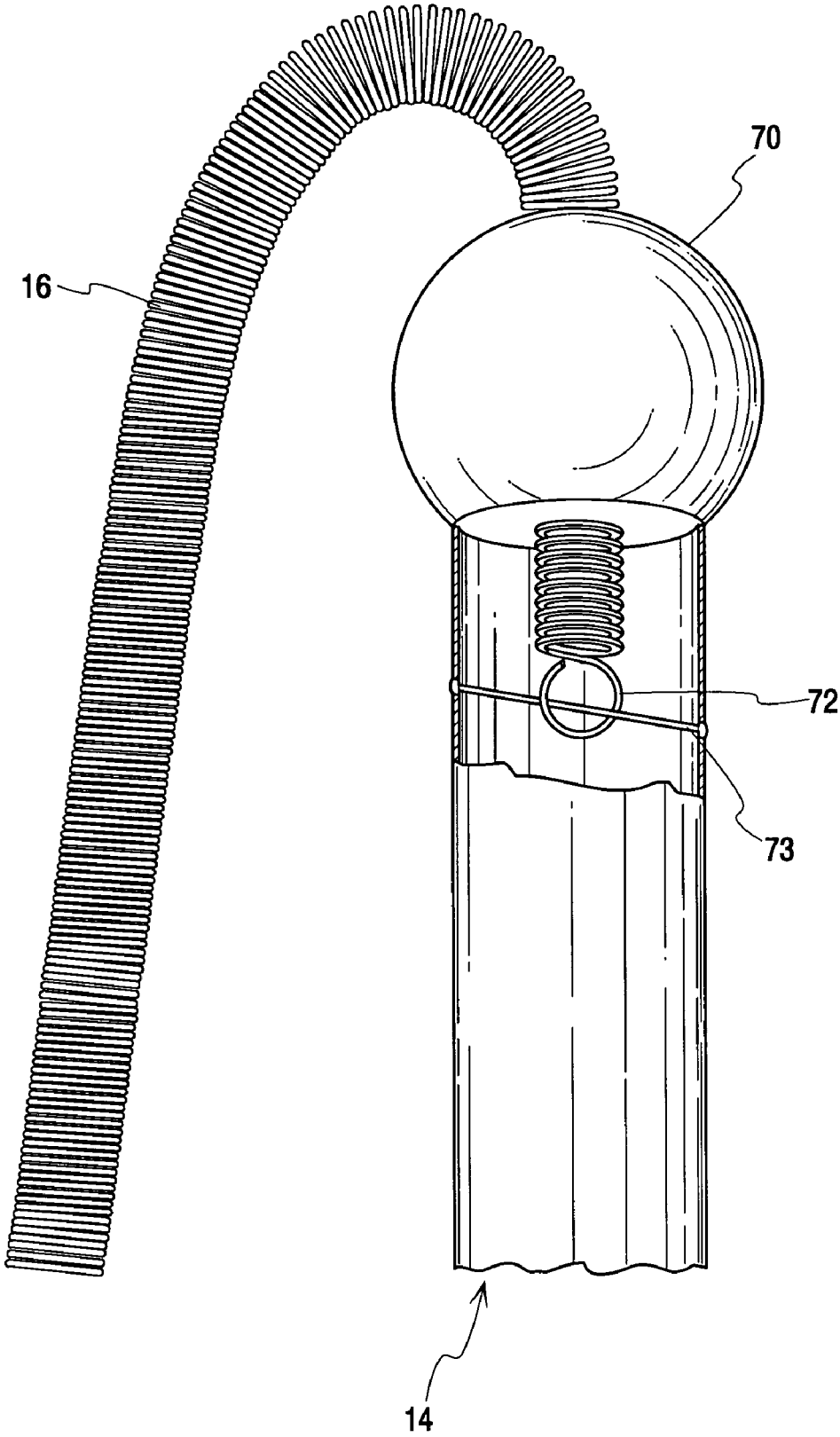
FIG. 3 is a representative view of the top of the pole.
Figure 4:
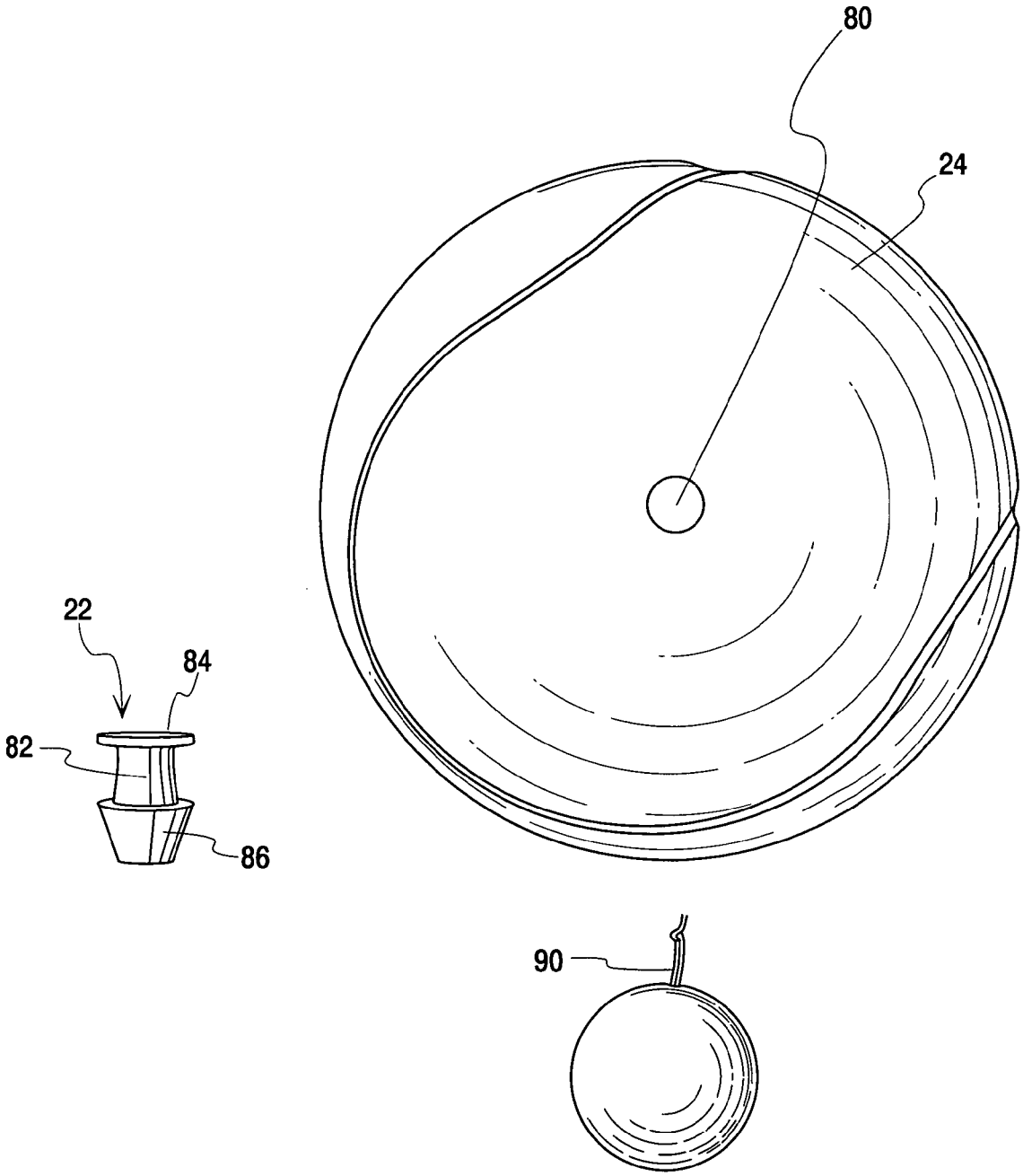
FIG. 4 represents the ball and ball adapter.

FIG. 3 represents the top end of pole 14. FIG. 3 is diagrammatic. Preferably, the top of pole 14 includes a rounded surface 70, thereby adding a further safety feature against accidental harm if anyone should fall upon the apparatus 10. Extension spring 16 may be between about 6 and 12 inches in length (illustratively 10 inches long) and may have a diameter on the order of one-fourth of one inch to one half of one inch. The rounded end 70 may be a separate end cap fitted onto pole 14. Extension spring 16 is fitted through an opening of rounded top 70 and extends part-way into the preferably hollow pole 14. Preferably the extension spring 16 includes an end ring 72 at each end. Preferably the portion of spring 16 inside pole 14 is covered with a shrink wrap or shrink tube which, when heated, shrinks to the size of the coil. The coil is held in place with a cross pin 73 passing through end ring 72 and secured to the pole 14 by welding or glue or other mechanical means, similar in configuration and mounting to lower cross pin 41 (for the compression spring 40). The manner of engaging spring 16 to the top of pole 14 can be varied to any convenient structure that secures these pieces together.

Returning to FIG. 1, at the far end of extension spring 16, swivel 18 connects an elastic member 20 to the extension spring 16. Illustratively, swivel 18 may be connected to another end ring 72 of spring 16 on one side and may engage the elastic member by any convenient means such as by a pinch fitting, a knot tied in the elastic, or otherwise. Elastic member 20 is illustratively a braided elastic that is between about 10 and 15 feet in length (illustratively 12 feet in length). It will be appreciated that elastic member 20 can be stretched axially, as can extension spring 16.

As noted above, the far end of elastic member 20 is connected (directly or indirectly) to a practice ball 24. Ball 24 may comprise a tennis ball, a "Z-ball™," a rubber ball, a glow ball, or any other convenient ball. Preferably, ball 24 is provided with a hole 80 extending through its outer wall so that an attachment device 22 may be connected to the ball. Attachment member 22 may comprise a plastic member having a central shank 82 with an annular flange 84 at one end and a truncated conical section 86 at the other end. Attachment device 22 preferably has a central opening running through the shank 82, flange 84, and conical section 86. Preferably, the outside dimension of shank 82 is approximately equal to the inside dimension of hole 80 in ball 24. Preferably, a cord illustratively 4 inches in length is inserted through the axial hole in attachment device 22 and secured thereto by, for example, one or more knots in the cord that are larger than the diameter of the hole. The cord extending through attachment device 22 may be connected to the otherwise free end of elastic member 20 by either a suitable knot or connector. With cord 90 secured to attachment device 22, one inserts attachment device 22 through the hole 80, with the downward pointing conic section 86 entering hole 80 first. After the conic section 86 clears the outer wall of the ball, the outer wall of the ball surrounds shank 82, and ball attachment device 22 is prevented from moving further toward the center of ball 24 by the flange 84. Flange 84 may have the shape illustratively at the top of a pan head screw, thus having a flat underside and a rounded top. Preferably the attachment device 22 provides an airtight seal on the ball 24. A detachable clip may be used to connect cord 90 to the elastic member 20 thereby permitting the ball to be changed.

With the unit thus assembled, a player may hit the ball with a racquet (or other device) in a forward direction. As the ball travels forward, it unwinds the elastic member 20 and extension spring 16 and eventually stretches them longitudinally. These extensible members stretch and, if the ball has been hit hard enough, sufficient torque is applied to the top of pole 14 by the forward momentum of the ball 24 to cause compression spring 40 to bend, allowing pole 14 to articulate slightly. Pole 14 may have some resilience also and may itself bend. Ultimately, however, the forward momentum and kinetic energy of the moving ball 24 is overcome by the stretched elastic member 20, the possibly extended extension spring 16, the possibly extended compression spring 40, and the possible bend in the pole 14. These cause the ball to return toward the player. Typically, with a 15 inch height of the pole above the 3 inch high base, ball 24 will bounce once if the player is standing approximately beside apparatus 10. However, if the player steps back, the ball may bounce twice before the player hits it again with the racquet, reversing the direction of travel of the ball and starting a new cycle. Apparatus 10 provides an automatic and dynamic ball return system that adjusts to a player's skill level, heightening the challenge and overall experience of the player. The harder that a player hits the ball, the faster it returns. This device thus is suitable for recreation along with fitness. It calls for stamina, reflexes and eye-hand coordination. A user can use a tennis racquet, squash racquet, or racquetball racquet.

The multiple ball attachments can include a pressurized tennis ball, a rubber or non-rubber ball, a super Z-ball or a glowing phosphorescent ball. Other balls can be used. With a glow ball, the device 10 can be used at night.

After use, the player can unscrew the twist cap and empty the water, sand, or other fill that has been used from the base and thereby reduce the weight of apparatus 10 if desired. On the next use, however, the user will need to refill the base 12. Alternatively, the user can leave the fill contents inside base 12.

Other forms of bases and poles can be used that permit, for example, pole 14 to articulate at a middle section of its length instead of articulating at the base.

A version of the preferred apparatus illustrated in the drawings and described herein may be called a "SWISH-BALL" (trademark) ball return apparatus.

Numerous variations can be devised which remain within the scope and spirit of the present invention which is defined by the following claims.

The invention claimed is:

1. A ball return apparatus comprising:

a base member having a generally hollow interior portion and a first opening in said base member;

a pole extending upward from said base member;

a spring operatively connecting said pole to said base member, a lower portion of said spring extending in said first opening in said base member, an upper portion of said spring extending into said pole;

said spring permitting said pole to articulate from said base member;

a tether extending from the pole; and a ball coupled to said tether.

2. The ball return apparatus of claim 1 wherein said base member generally hollow interior portion is configured to be filled at least partially with a liquid or other substance and said base has a selectively sealable second opening communicating with said hollow interior portion.

3. The ball return apparatus of claim 1 wherein said tether is flexible and extensible.

4. The ball return apparatus of claim 3 wherein said tether includes an elastic member.

5. The ball return apparatus of claim 3 wherein said tether includes an extension spring.

6. The ball return apparatus of claim 3 wherein said tether includes an extension spring coupled to said pole and an elastic member coupled to said extension spring.

7. The ball return apparatus of claim 1 further including a swivel connector at one end of said tether.

8. The ball return apparatus of claim 1 wherein a top of said pole is located substantially 15 inches above the bottom of said base member.

9. The ball return apparatus of claim 1, wherein the upper portion of the spring is attached to the pole by a cross pin and the lower portion of the spring is secured to the base member by a connector.

10. The ball return apparatus of claim 1, wherein the lower portion of the spring is secured to the base member by a connector accessible by an underside of the base member.

11. The ball return apparatus of claim 2, wherein said first opening is adapted to separate the lower portion of the spring from a liquid or other substance contained within the hollow interior portion of the base member.

12. A ball return apparatus comprising:

a base member;

a pole extending generally vertically from said base member, said pole being movably mounted with respect to said base member, said pole having a hollow interior portion at least at its bottom;

a compression spring operatively connected to said base member and said pole to impart resistance against articulation of said pole and to urge said pole toward a rest position if said pole articulates away therefrom;

said compression spring being housed entirely within said base member and said hollow interior portion of said pole;

a tether extending from the pole, said tether including an extension spring and an elastic member coupled to said extension spring; and a ball connected to said tether.

13. The ball return apparatus of claim 12 further comprising:

a ball attachment device having a shank, a truncated conical section at one end of the shank, and a flange at the other end of the shank; and wherein said ball includes a hole generally corresponding in size to a dimension of said shank.

14. The ball return apparatus of claim 13 wherein said ball attachment device includes a channel extending through said flange, shank, and conical section; and further comprising a cord passing through said channel into the interior of the ball, said cord being coupled to said tether.

15. The ball return apparatus of claim 12 further including a swivel connector at one end of said tether.

16. The ball return apparatus of claim 12:

wherein a top of said pole is located about 18 inches above the bottom of said base member, and wherein said base has a generally hollow interior portion, an opening in said base member communicating with said generally hollow interior portion, and a cap for closing said opening.

17. A ball return apparatus comprising:

a base member having a generally hollow interior portion, an opening in said base member communicating with said generally hollow interior portion, and a cap for closing said opening;

a pole extending generally vertically from said base member, said pole being movably mounted to said base to permit said pole to articulate from said base;

a compression spring operatively connected to said base and said pole to impart resistance against said articulation of said pole and to urge said pole toward a rest position if said pole articulates away therefrom;

a tether extending from the pole, said tether including an extension spring and an elastic member coupled to said extension spring;

a ball attachment device coupled to said tether, said ball attachment device having a shank, a truncated conical section at one end of the shank, and a flange at the other end of the shank; and a ball having a hole generally corresponding in size to a dimension of said shank.

18. The ball return apparatus of claim 17 wherein said ball attachment device includes a hole extending through said flange, shank, and conical section; and further comprising a cord passing through said hole into the interior of the ball, said cord being coupled to said tether.

19. The ball return apparatus of claim 17 wherein said pole has a rounded top.

20. The ball return apparatus of claim 17:

wherein a top of said pole is located about 18 inches above the bottom of said base, wherein said extension spring is between about 6 and 12 inches in length, and wherein said elastic member is between about 10 and 15 feet in length.

* * * * *